US011602034B2

(12) United States Patent
Magielse et al.

(10) Patent No.: US 11,602,034 B2
(45) Date of Patent: Mar. 7, 2023

(54) FORMING GROUPS OF DEVICES BY ANALYZING DEVICE CONTROL INFORMATION

(71) Applicant: SIGNIFY HOLDING B.V., Eindhoven (NL)

(72) Inventors: Remco Magielse, Tilburg (NL); Dzmitry Viktorovich Aliakseyeu, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 185 days.

(21) Appl. No.: 16/612,048

(22) PCT Filed: May 3, 2018

(86) PCT No.: PCT/EP2018/061275

§ 371 (c)(1),
(2) Date: Nov. 8, 2019

(87) PCT Pub. No.: WO2018/206378

PCT Pub. Date: Nov. 15, 2018

(65) Prior Publication Data

US 2020/0170094 A1 May 28, 2020

(30) Foreign Application Priority Data

May 8, 2017 (EP) ..... 17169893

(51) Int. Cl.
*H05B 47/10* (2020.01)
*H05B 47/19* (2020.01)
(Continued)

(52) U.S. Cl.
CPC ..... *H05B 47/19* (2020.01); *H05B 47/155* (2020.01); *H05B 47/18* (2020.01)

(58) Field of Classification Search
CPC ..... H05B 47/18; H05B 47/19; H05B 47/20; H05B 47/105; H05B 47/155; H05B 47/175; H05B 47/185; H05B 47/195
See application file for complete search history.

(56) References Cited

U.S. PATENT DOCUMENTS 8,214,084 B2 * 7/2012 Ivey ..... G05B 15/02 700/275
9,595,880 B2 * 3/2017 Knode ..... H05B 47/175
(Continued)

FOREIGN PATENT DOCUMENTS

WO 2007115401 A1 10/2007
WO 2008117244 A1 10/2008

*Primary Examiner* — Tung X Le

(57) ABSTRACT

A system (1) is configured to receive device control information. The device control information specifies how devices, e.g. lights, should be controlled. The device control information may identify specific devices or specify device requirements, for example. The system is further configured to form a group of identified devices by analyzing the device control information, the identified devices of the group being controlled similarly according to the device control information. The system is also configured to transmit at least one message comprising an identifier of the group to allow the identified devices to be configured to carry out one or more commands comprising the identifier when receiving such one or more commands. The at least one message identifies the identified devices of the group.

15 Claims, 4 Drawing Sheets

(51) Int. Cl.
*H05B 47/155* (2020.01)
*H05B 47/18* (2020.01)

(56) References Cited

U.S. PATENT DOCUMENTS

| | | | | |
|---|---|---|---|---|
| 10,085,328 | B2 * | 9/2018 | Barna | H05B 47/19 |
| 2008/0026579 | A1 | 1/2008 | Lai et al. | |
| 2009/0218951 | A1 | 9/2009 | Weaver | |
| 2010/0277107 | A1 | 11/2010 | Baaijens et al. | |
| 2012/0320262 | A1 * | 12/2012 | Chung | H05B 45/20<br>348/370 |
| 2014/0167642 | A1 * | 6/2014 | Chobot | H05B 47/155<br>315/312 |
| 2015/0296599 | A1 | 10/2015 | Recker et al. | |
| 2015/0373812 | A1 * | 12/2015 | Feri | H05B 47/175<br>315/152 |
| 2016/0092198 | A1 | 3/2016 | Vangeel et al. | |

* cited by examiner

FORMING GROUPS OF DEVICES BY ANALYZING DEVICE CONTROL INFORMATION

CROSS-REFERENCE TO PRIOR APPLICATIONS

This application is the U.S. National Phase application under 35 U.S.C. § 371 of International Application No. PCT/EP2018/061275, filed on May 3, 2018, which claims the benefit of European Patent Application No. 17169893.9, filed on May 8, 2017. These applications are hereby incorporated by reference herein.

FIELD OF THE INVENTION

The invention relates to a system for facilitating control of devices.

The invention further relates to a method of facilitating control of devices.

The invention also relates to a computer program product enabling a computer system to perform such a method.

BACKGROUND OF THE INVENTION

Philips Hue is a line of LED lamps that can be controlled via a mobile phone or tablet. Philips Hue employs a bridge between the mobile phone or tablet and the locally installed lamps. The bridge and the locally installed lamps form a personal area network (PAN). To control the lamps, the bridge broadcasts messages to all lamps in range via Inter-PAN communication. Every lamp is assigned an address and every message contains a list of address-value pairs. Each lamp reads the value for his own address and sets itself to a light state based on the corresponding value.

A limitation of the current Philips Hue products is that there is a limit to the number of address-value pairs that can be listed in a single message and this limit is typically not that high, e.g. twelve. It is not often not possible or not desirable to remove this limit.

SUMMARY OF THE INVENTION

It is a first object of the invention to provide a system for facilitating control of devices, which allows more devices to be controlled without increasing the size of the control messages.

It is a second object of the invention to provide a method of facilitating control of devices, which allows more devices to be controlled without increasing the size of the control messages.

In a first aspect of the invention, the system for facilitating control of devices (by a controller) comprises at least one receiver, at least one transmitter, and at least one processor configured to: use said at least one receiver to receive device control information, said device control information specifying how devices should be controlled (by the controller), form a group of identified devices by analyzing said device control information, said identified devices of said group being controlled (by the controller) similarly according to said device control information, and use said at least one transmitter to transmit at least one message comprising an identifier of said group to allow said identified devices to be configured to carry out one or more commands comprising said identifier when receiving such one or more commands, said at least one message identifying said identified devices of said group (i.e. the messages comprises information related to the identity of each of said identified devices of said group). The device control information may identify specific devices or specify device requirements, for example. The devices may be lights, for example. The devices may be controlled by a controller. The system then provides grouping of devices and the controller provides control over the devices. In other words, the system facilitates control of the devices. Although the controller may be a separate device, it can alternatively be part of the system, for example part of the at least one processor. This does not exclude the controller function being partly implemented in the system and partly by a separate entity (i.e. distributed).

The inventors have recognized that by forming groups of identified devices that are expected or known to be controlled similarly according to certain device control information based on the analysis of this certain device control information, it may be possible to control more devices without increasing the size of the control messages (e.g. without exceeding to the number of address-value pairs that can be listed in a single message).

Said device control information may comprise a device script, said device script may comprise a plurality of commands, and each of said plurality of commands may specify required properties of one or more devices to be controlled. The analysis of a device script is especially beneficial on a rendering device, e.g. a mobile device, a PC or an Internet server, as the rendering device will normally need to obtain the device script anyway in order to render it. An advantage of the analysis of device script is that a device script can often be obtained in its entirety before rendering is started, which allows groups to be formed most optimally. A device script typically comprises a set of data elements in which each data element is indicative of a characteristic of an output generated by a device and a sequence of the data elements has been defined (i.e. the script is time-based). If the devices are lights, the output generated by the devices are light characteristics, e.g. light intensity and/or light color. A device script typically does not identify specific devices.

Said at least one processor may be configured to identify one or more devices having said required properties for each of said one or more commands. A device script normally does not identify any specific devices and it is therefore beneficial if the system tries to identify these specific devices based on the required properties specified in the commands of the device script.

Said at least one processor may be configured to form said group of identified devices from said identified one or more devices by analyzing said commands. After the specific devices have been identified, the at least one processor may determine which identified devices will be controlled similarly according to the device script and use this to form groups of identified devices.

Said device control information may comprise a plurality of commands for controlling a plurality of identified devices and said plurality of identified devices may comprise at least said identified devices of said group. Instead of a device script, lower-level commands addressed to identified devices may be analyzed. The analysis of these lower-level commands is especially beneficial when performed on a bridge, as the bridge will normally receive such commands anyway. This is especially advantageous if the rendering device that renders the device script does not support group forming.

Said device control information may identify at least one previously formed group of one or more of said plurality of identified devices. The rendering device may already have formed groups, but even if the rendering device does support group forming, it may be advantageous to let the bridge check whether groups can be formed more optimally.

Said at least one processor may be further configured to use said at least one transmitter to transmit one or more commands for controlling one or more groups of identified devices and/or one or more individually identified devices, said one or more groups of identified devices comprising said group of identified devices. After the groups of identified devices have been formed, (lower-level) commands, e.g. with address-value pairs, normally need to be transmitted with group addresses (identifiers) to the identified devices. These commands may be transmitted by a rendering device directly to the identified devices, by a bridge directly to the identified devices or by a rendering device to the identified devices via a bridge, for example.

Said at least one processor may be configured to form said group and transmit said at least one message before transmitting any of said commands. Preferably, the device control information is a device script that has been obtained in its entirety before rendering of the device script starts so that the device script can be analyzed and groups can be formed before any of the (lower-level) commands are transmitted to the identified devices. This allows groups to be formed most optimally.

Said at least one processor may be configured to form said group and transmit said at least one message after transmitting at least one of said commands. If it is not possible to obtain a device script in its entirety before rendering of the device script starts, e.g. because the device script is streamed, because the system is a bridge that is not able to obtain the device script or because the device script is generated on-the-fly (e.g. by a game), then it may be necessary to already start transmitting (lower-level) commands and form groups later, as soon as sufficient commands have been processed to be able to reliably form groups. Before groups are formed based on analysis of the device control information, default groups may be used that are independent of device control information. Groups may be fine-tuned during the rendering of the device script. Groups may be dissolved when the rendering has ended, e.g. when all (lower-level) commands have been transmitted to the devices.

Said at least one processor may be further configured to form one or more further groups of identified devices by analyzing said device control information, said identified devices of each of said one or more further groups being controlled similarly according to said device control information. The formation of further groups may allow more devices to be controlled without increasing the size of the control messages (which comprise the control commands).

In a second aspect of the invention, the method of facilitating control of devices comprises receiving device control information, said device control information specifying how devices should be controlled, forming a group of identified devices by analyzing said device control information, said identified devices of said group of devices being controlled similarly according to said device control information, and transmitting at least one message comprising an identifier of said group to allow said identified devices to be configured to carry out one or more commands comprising said identifier when receiving such one or more commands, said at least one message identifying said identified devices of said group. The method may be implemented in hardware and/or software.

Said device control information may comprise a device script, said device script may comprise a plurality of commands, and each of said plurality of commands may specify required properties of one or more devices to be controlled.

Said device control information may comprise a plurality of commands for controlling a plurality of identified devices and said plurality of identified devices may comprise at least said identified devices of said group.

Said method may further comprise transmitting one or more commands for controlling one or more groups of identified devices and/or one or more individually identified devices, said one or more groups of identified devices comprising said group of identified devices.

Moreover, a computer program for carrying out the methods described herein, as well as a non-transitory computer readable storage-medium storing the computer program are provided. A computer program may, for example, be downloaded by or uploaded to an existing device or be stored upon manufacturing of these systems.

A non-transitory computer-readable storage medium stores at least one software code portion, the software code portion, when executed or processed by a computer, being configured to perform executable operations comprising: receiving device control information, said device control information specifying how devices should be controlled, forming a group of identified devices by analyzing said device control information, said identified devices of said group of devices being controlled similarly according to said device control information, and transmitting at least one message comprising an identifier of said group to allow said identified devices to be configured to carry out one or more commands comprising said identifier when receiving such one or more commands, said at least one message identifying said identified devices of said group.

As will be appreciated by one skilled in the art, aspects of the present invention may be embodied as a device, a method or a computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit", "module" or "system." Functions described in this disclosure may be implemented as an algorithm executed by a processor/microprocessor of a computer. Furthermore, aspects of the present invention may take the form of a computer program product embodied in one or more computer readable medium(s) having computer readable program code embodied, e.g., stored, thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples of a computer readable storage medium may include, but are not limited to, the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of the present invention, a computer readable storage medium may be any tangible medium that can contain, or store, a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber, cable, RF, etc., or any suitable combination of the foregoing. Computer program code for carrying out operations for aspects of the present invention may be written in any combination of one or more programming languages, including an object oriented programming language such as Java™, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer, or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present invention are described below with reference to flowchart illustrations and/or block diagrams of methods, apparatus (systems), and computer program products according to embodiments of the present invention. It will be understood that each block of the flowchart illustrations and/or block diagrams, and combinations of blocks in the flowchart illustrations and/or block diagrams, can be implemented by computer program instructions. These computer program instructions may be provided to a processor, in particular a microprocessor or a central processing unit (CPU), of a general purpose computer, special purpose computer, or other programmable data processing apparatus to produce a machine, such that the instructions, which execute via the processor of the computer, other programmable data processing apparatus, or other devices create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the figures illustrate the architecture, functionality, and operation of possible implementations of devices, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the blocks may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustrations, and combinations of blocks in the block diagrams and/or flowchart illustrations, can be implemented by special purpose hardware-based systems that perform the specified functions or acts, or combinations of special purpose hardware and computer instructions.

BRIEF DESCRIPTION OF THE DRAWINGS

These and other aspects of the invention are apparent from and will be further elucidated, by way of example, with reference to the drawings, in which.

Corresponding elements in the drawings are denoted by the same reference numeral.

DETAILED DESCRIPTION OF THE EMBODIMENTS

Figure 1:
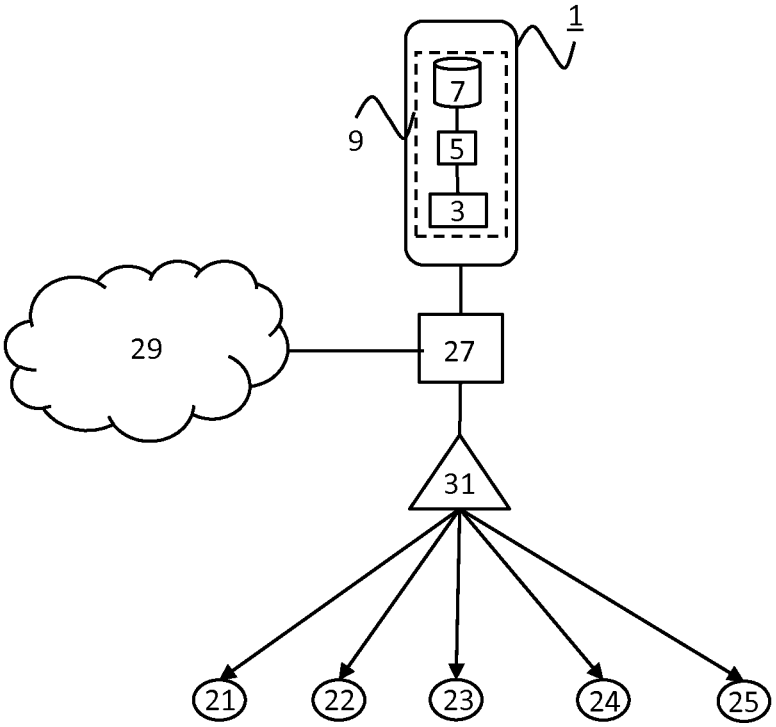
FIG. 1 is a block diagram of a first embodiment of the system of the invention.

In a first embodiment, the invention is implemented in a rendering device: mobile device 1, see FIG. 1. The mobile device 1 comprises a transceiver 3, a processor 5, a memory 7 and a display 9. Five lights are present: lights 21 to 25. The lights 21 to 25 can be controlled via a bridge 31. The bridge 31 sends commands to the lights 21 to 25 via ZigBee, a protocol based on ZigBee or another PAN protocol, for example. The bridge 31 is connected to a wireless LAN via a wireless LAN access point 27. The processor 5 of the mobile device 1 is configured to control the lights 21 to 25 via bridge 31. In this embodiment, the mobile device 1 is connected to the same wireless LAN as the bridge 31 via the same wireless LAN access point 27.

The processor 5 of the mobile device 1 is configured to use transceiver 3 to receive a device script (e.g. a light script) from another device on the Internet 29. The mobile device 1 may receive the entire device script (also referred to as "pre-loaded content") and then start rendering it or the mobile device 1 may stream the device script, i.e. start rendering it as soon as a first part has been received, while the remainder is being receiving during rendering, or the mobile device 1 may generate the device script on-the-fly, e.g. if the mobile device 1 is running a game.

A device script may define, for example, certain effects to be rendered, such as "ice effect", "my own ambiance 01", "my own ambiance 02", "cold blast" and "fireplace". For each effect, certain properties may be defined, such color and/or intensity, duration and transition speed. A simple effect may simply specify a color and/or intensity. A first type of advanced effect may specify, for example, that a first color and/or intensity is generated at moment t0 (the start of the effect) and a second color and/or intensity is generated at moment t1 (and possibly, further colors and/or intensities may be specified for further moments). A second type of advanced effect may specify, for example, that a first color and/or intensity transitions to a second color and/or intensity at a specified transition speed.

The device script may specify a plurality of commands (also referred to as elements) and for each command: which effect(s) is/are to be rendered at which position(s) and at which moment. The moment may be specified as an offset from the start of the rendering, for example. The position may be specified, for example, as "left", "right", "front", "back" and "all" or as "all", left", "right", "front", "back", "front-left", "back-right", etc.

The device script may also specify a minimum number of devices that needs to be available, types of devices that need to be available, and a minimum number of devices per type that needs to be available. A light script may require, for example, that at least two lights are available. Other types of devices may include speakers and/or fans, for example.

Before rendering the device script, the mobile device 1 first determines which controllable devices are available for rendering the device script. The mobile device 1 receives from the bridge 31 a list of identified devices which available, i.e. lights 21 to 25, and their characteristics. These characteristics include their capabilities and their positions. The mobile device 1 may then check whether the device script can be rendered using these devices. For example, the device script may require that at least two lights are available and since five lights are available (lights 21 to 25), the mobile device 1 may determine that the device script can be rendered.

Rendering a device script involves mapping each element (command) of the device script to one or more of the identified devices. For example, if an element specifies that a "fireplace" effect, which involves red and yellow colors, should be rendered at the front of the room 15 seconds after the rendering has started, the mobile device 1 will determine which of lights 21 to 25 can output red and yellow colors (e.g. color lights) and which of lights 21 to 25 are located at the front of the room (e.g. a first light has a location "front-left" and a second light has a location "front-right"). If a device does not have the required properties specified in an element, it is not selected as a device to be controlled for rendering that element.

If the entire device script is available, all elements may be mapped to the identified devices before rendering starts. Alternatively, if the device script is streamed or generated on-the-fly, an element may be mapped to the identified devices as soon as it is received or generated. After the mapping, commands are generated for the identified devices. These commands are lower-level than the commands (elements) of the device script. The device script is a first kind of device control information. The lower-level commands are a second kind of device control information. In both cases, the device control information specifies how devices should be controlled, but while the commands of the device script do not identify any specific devices, the commands for the identified devices of course do (and are therefore considered to be lower-level).

The processor 5 is configured to form a group of identified devices by analyzing the device control information, the identified devices of the group of devices being controlled similarly according to the device control information. In the embodiment of FIG. 1, the processor 5 is configured to form a group of identified devices from the identified one or more devices by analyzing the commands (elements) of the device script. The processor 5 is configured to use the transceiver 3 to transmit at least one message comprising an identifier of the group to allow the identified devices to be configured to carry out one or more commands comprising the identifier when receiving such one or more commands. The at least one message identifies the identified devices of the group.

In the embodiment of FIG. 1, the at least one message is transmitted to the bridge 31 via an Application Programming Interface (API) of the bridge 31. The bridge 31 then informs lights 21 to 25 to which group(s) they have been assigned. Each of the lights 21 to 25 then knows that it needs to carry out a command comprising a group identifier identifying a group of which it is a member. The bridge 31 may inform lights 21 to 25 with a unicast, multicast or broadcast message. The lights 21 to 25 may confirm receipt of this message. After the rendering has ended, the group assignments may be deleted. The bridge 31 may instruct the lights 21 to 25 to delete the group assignments. The mobile device 1 may inform the bridge 31 that the rendering has ended.

The processor 5 is further configured to form one or more further groups of identified devices by analyzing the device control information, the identified devices of each of the one or more further groups being controlled similarly according to the device control information. In this way, multiple groups of identified devices may be created. If a certain identified device is not controlled in similar manner as another identified device, e.g. because it is on another side of the room and has different capabilities than the other identified devices, it may be better not to group this device and control it individually instead. By forming groups of devices and using group addresses (identifiers) instead of individual addresses in control messages, the size of these control messages can be reduced, thereby allowing more devices to be controlled with the same size of control messages without reducing the frequency at which commands may be transmitted.

The processor 5 is further configured to use the transceiver 3 to transmit one or more commands for controlling one or more groups of identified devices and/or one or more individually identified devices. If the entire device script is available, these one or more (lower-level) commands may all be determined before the first command is transmitted. Alternatively, if the device script is streamed or generated on-the-fly, a (lower-level) command may be determined as soon as a new device script command (element) is received or generated. In the former case, the processor 5 is preferably configured to form the group and transmit the at least one message before transmitting any of the commands. In the latter case, the processor 5 is preferably configured to form the group and transmit the at least one message after transmitting at least one of the commands. This at least one of the commands is only intended for controlling individually identified devices, as not enough information is present at that time to form groups of identified devices based on analysis of the device control information. In the embodiment of FIG. 1, the one or more (lower-level) commands are transmitted to the bridge 31 via an Application Programming Interface (API) of the bridge 31.

In the embodiment shown in FIG. 1, the mobile device 1 comprises one processor 5. In an alternative embodiment, the mobile device 1 comprises multiple processors. The processor 5 of the mobile device 1 may be a general-purpose processor, e.g. from ARM or Qualcomm, or an application-specific processor. The processor 5 of the mobile device 1 may run an iOS, Windows or Android operating system for example. The invention may be implemented using a computer program running on one or more processors. In the embodiment shown in FIG. 1, a receiver and a transmitter have been combined into a transceiver 3. In an alternative embodiment, one or more separate receiver components and one or more separate transmitter components are used. In an alternative embodiment, multiple transceivers are used instead of a single transceiver. The transceiver 3 may use one or more wireless communication technologies to transmit and receive data, e.g. LTE, Wi-Fi, ZigBee and/or Bluetooth. The memory 7 may comprise one or more memory units. The memory 7 may comprise solid state memory, for example. The display 9 may comprise a LCD or OLED display panel, for example. The display 9 may be a touch screen, for example.

Figure 2:
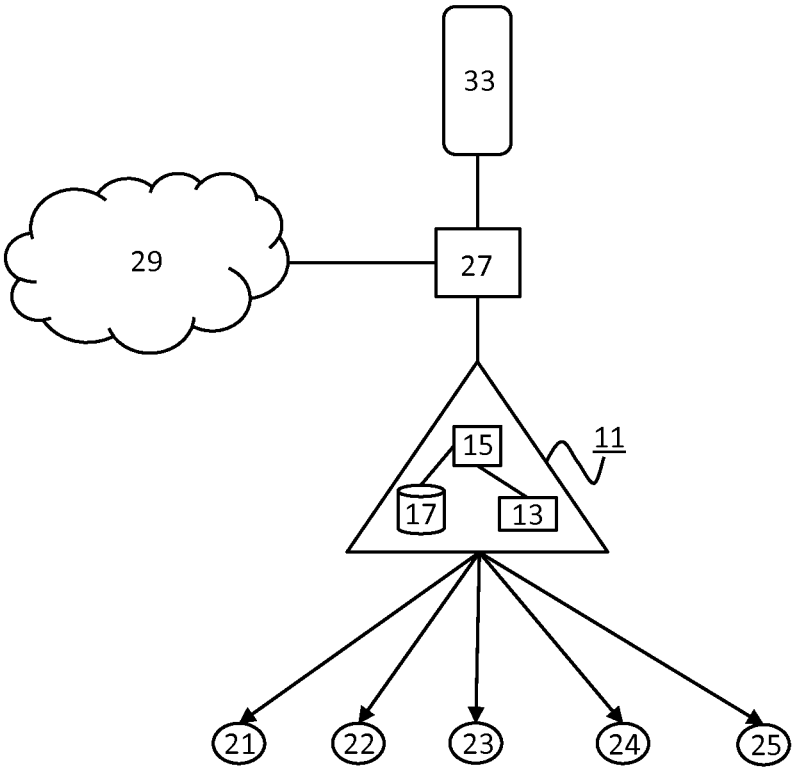
FIG. 2 is a block diagram of a second embodiment of the system of the invention.

In a second embodiment, the invention is implemented in a bridge 11, see FIG. 2. The bridge 11 comprises a transceiver 13, a processor 15 and a memory 17. A mobile device 33 receives and processes a device script a described in relation to FIG. 1, but no groups of identified devices are formed by the mobile device 33 and the lower-level commands transmitted by the mobile device 33 are only intended for controlling individually identified devices. The mobile device 33 does receive from the bridge 11 a list of identified devices which are present and available, i.e. lights 21 to 25, and their characteristics, to map elements of the device script to identified devices.

In the embodiment of FIG. 2, the processor 15 is configured to form a group of identified devices from the identified one or more devices by analyzing the lower-level commands received from the mobile device 33. In other words, the device control information comprises a plurality of commands for controlling a plurality of identified devices and the plurality of identified devices comprises at least the identified devices of the group. The processor 15 is configured to form a group of identified devices by analyzing the device control information, the identified devices of the group being controlled similarly according to the device control information. The processor 15 is configured to use the transceiver 3 to transmit at least one message comprising an identifier of the group to allow the identified devices to be configured to carry out one or more commands comprising the identifier when receiving such one or more commands. The at least one message identifies the identified devices of the group.

The processor 15 is further configured to use the transceiver 3 to transmit one or more commands for controlling one or more groups of identified devices and/or one or more individually identified devices. Thus, the bridge 11 converts the lower-level commands received from the mobile device 33 to other lower-level commands, which the bridge 11 then transmits to the lights 21 to 25. The processor 15 is preferably configured to form the group and transmit the at least one message after transmitting at least one of the commands, as it does not have enough information to form groups of identified devices based on analysis of the device control information after receiving only one lower-level command from the mobile device 33.

In the embodiment shown in FIG. 2, the bridge 11 comprises one processor 15. In an alternative embodiment, the bridge 11 comprises multiple processors. The processor 15 of the bridge 11 may be a general-purpose processor, e.g. from ARM or Qualcomm, or an application-specific processor. The processor 15 of the bridge 11 may run a Linux-based operating system, for example. The invention may be implemented using a computer program running on one or more processors. In the embodiment shown in FIG. 2, a receiver and a transmitter have been combined into a transceiver 13. In an alternative embodiment, one or more separate receiver components and one or more separate transmitter components are used. In an alternative embodiment, multiple transceivers are used instead of a single transceiver. The transceiver 13 may use one or more wireless communication technologies to transmit and receive data, e.g. LTE, Wi-Fi, ZigBee and/or Bluetooth. The memory 17 may comprise one or more memory units. The memory 17 may comprise solid state memory, for example.

In a variation on the embodiment of FIG. 2, the processor 15 may be configured to use the transceiver 13 to receive a device script, e.g. from the mobile device 33, and to form a group of available devices from the identified one or more devices by analyzing the by analyzing the commands (elements) of the device script.

Figure 3:
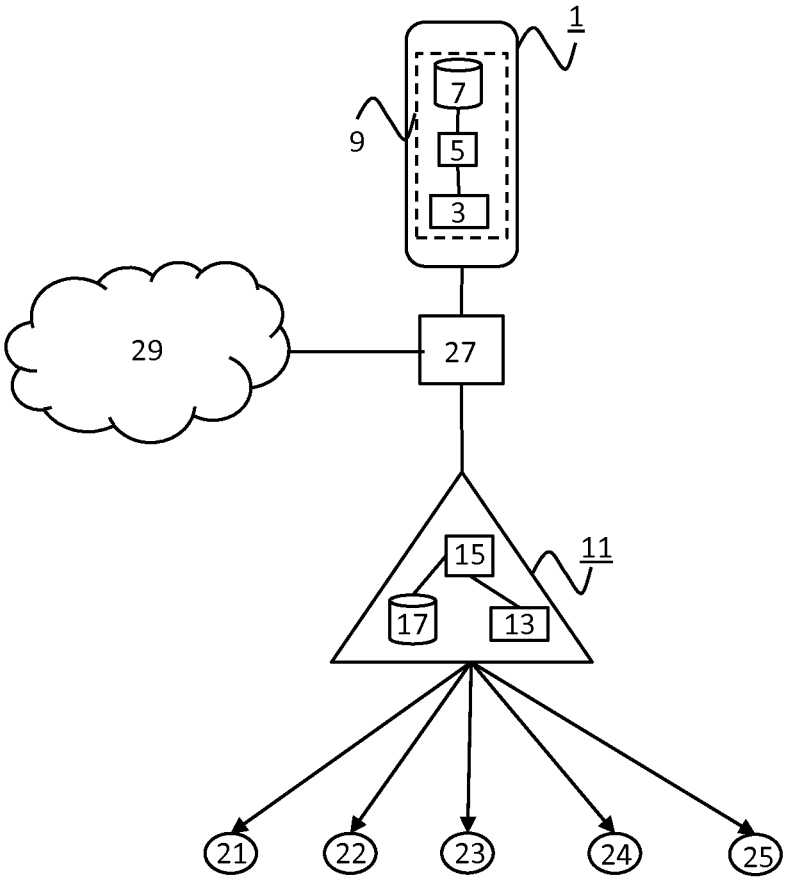
FIG. 3 is a block diagram of a third embodiment of the system of the invention.

In a third embodiment, the invention is both implemented in a mobile device 1 and in a bridge 11, see FIG. 3. The mobile device 1 of FIG. 3 corresponds to the mobile device 1 of FIG. 1. The bridge 11 of FIG. 3 corresponds to the bridge 11 of FIG. 2. In this third embodiment, the bridge 11 receives lower-level commands from the mobile device 1, but different than in the second embodiment, these lower-level commands also include commands for controlling one or more groups of identified devices. In other words, the device control information identifies at least one previously formed group of one or more of the plurality of identified devices. The bridge 11 may form different groups, e.g. more or fewer groups, than the mobile device 1 and therefore, the lower-level commands transmitted by the bridge 11 to the lights 21 to 25 may use different groupings than the lower-level commands received by the bridge from the mobile device 1.

Figure 4:
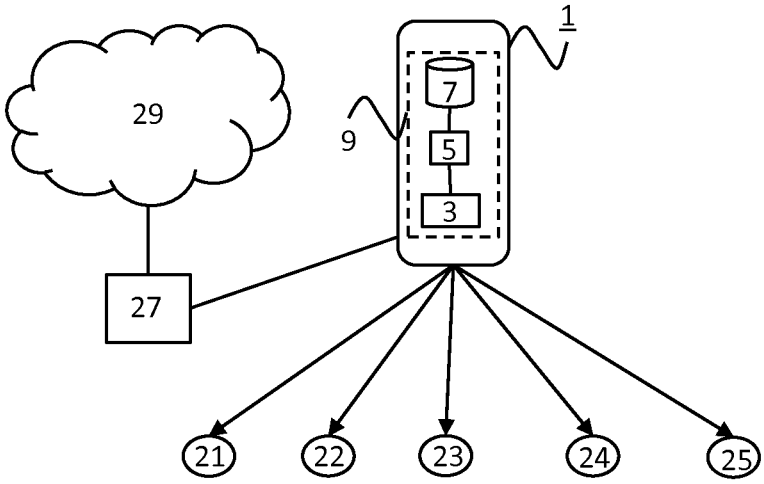
FIG. 4 is a block diagram of a fourth embodiment of the system of the invention.

In a fourth embodiment, the invention is implemented in a mobile device 1 and the mobile device 1 configured to communicate directly with lights 21 to 25, i.e. without the use of a bridge, see FIG. 4. In this embodiment, the mobile device 1 is able to transmit wireless signals using a protocol understood by the lamps 21 to 25, e.g. ZigBee or a proprietary protocol based on ZigBee. The mobile device 1 performs similarly as described in relation to FIG. 1, except that the mobile device 1 compiles a list of identified devices itself based on information received directly from the lights 21 to 25, which also comprises the characteristics of the lights, and that the mobile device 1 transmits the lower-level commands directly to the lights 21 to 25.

Figure 5:
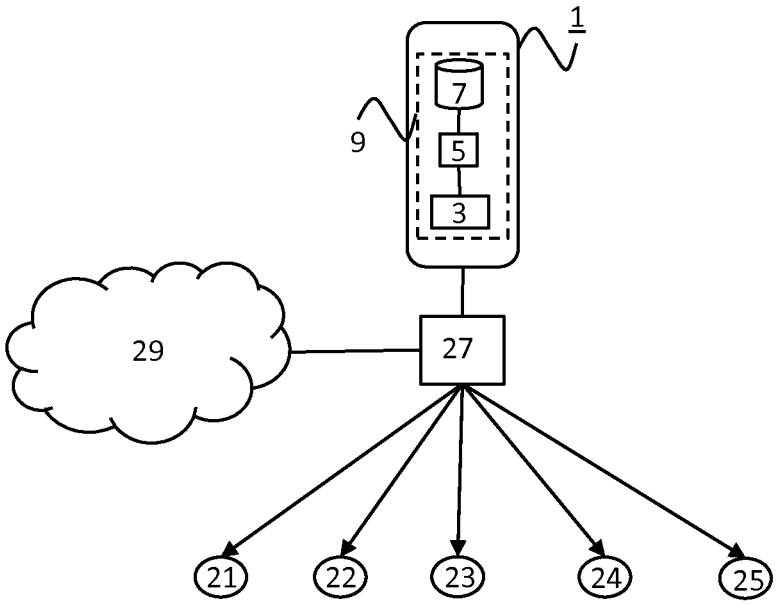
FIG. 5 is a block diagram of a fifth embodiment of the system of the invention.

In a fifth embodiment, the invention is implemented in a mobile device 1 and the mobile device 1 is configured to communicate with lights 21 to 25 without the use of a bridge, but via wireless LAN access point 27, see FIG. 5. In this embodiment, the lights 21 to 25 are able to receive and decode wireless LAN (e.g. Wi-Fi) signals transmitted by the wireless LAN access point 27. The mobile device 1 behaves similarly as described in relation to FIG. 4.

Figure 6:
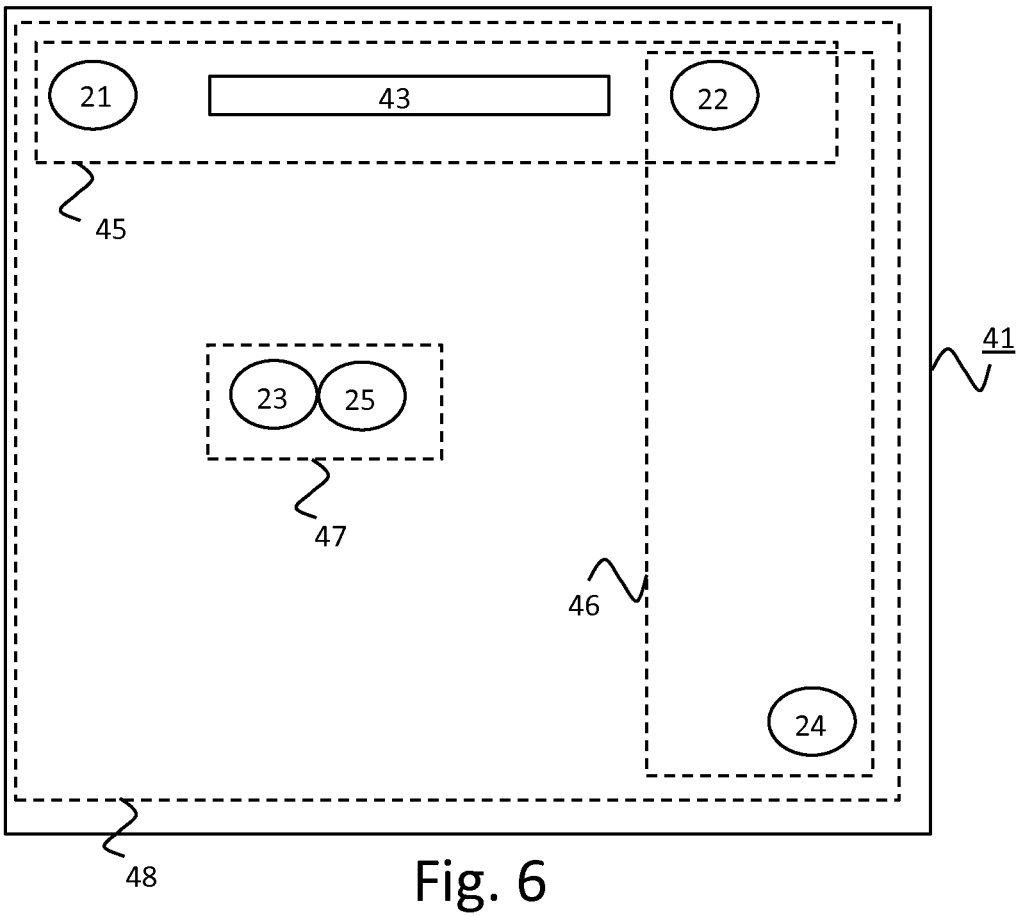
FIG. 6 shows an example of light groupings in a living room.

FIG. 6 shows an example of light groupings in a living room 41 which comprises a Television 43 and lights 21 to 25. A first group 45 comprises lights 21 and 22, e.g. because at least some of the effects of the device script being rendered specify a "front" position. A second group 46 comprises lights 22 and 24, e.g. because at least some of the effects of the device script being rendered specify a "right" position. A third group 47 comprises lights 23 and 25, e.g. because at least some of the effects of the device script being rendered specify a "center" position. A fourth group 48 comprises all five lights. Lights are typically controlled similarly, and therefore automatically grouped, if they have similar positions or similar capabilities.

Light 21 is thus part of groups 45 and 48. Light 22 is thus part of groups 45, 46 and 48. Light 23 is thus part of groups 47 and 48. Light 24 is thus part of groups 46 and 48. Light 25 is thus part of groups 47 and 48. These lights groups are used to illustrate the embodiments of FIGS. 1 to 3.

In the embodiment of FIG. 1, the mobile device 1 forms groups and the bridge 31 forwards the lower-level commands directly to the lights 21 to 25. For example, the bridge 31 receives the commands "L21-Red, G47-White, G46-Green" (L21 identifying light 21 and G47 identifying group 47) from the mobile device 1 and transmits the commands "L21-Red, G47-White, G46-Green" to the lights 21 to 25. The format "L21-Red, G47-White, G46-Green" has been used for illustrative purposes. In practice, the format may be encoded to be as short as possible.

In the embodiment of FIG. 2, the mobile device 33 ignores the grouping and transmits lower-level commands for individual lights to the bridge 11. The bridge 11 uses the grouping of FIG. 6 to convert the received lower-level commands to different lower-level commands, which it transmits to the lights 21 to 25. For example, the bridge 11 receives the commands "L21-Red, L22-Green, L23-White, L24-Green, L25-White" from the mobile device 33 and transmits the commands "L21-Red, G47-White, G46-Green" to the lights 21 to 25.

In the embodiment of FIG. 3, the mobile device 1 performs a partial grouping and the bridge 11 check and regroups if necessary. The bridge 11 uses the grouping of FIG. 6 to convert the received lower-level commands to different lower-level commands if necessary and forwards the received lower-level commands or transmits the different lower-level commands to the lights 21 to 25. As an example of the latter, the bridge 11 receives the commands "L21-Red, L22-Green, L24-Green, G47-White" from the mobile device 1 and transmits the commands "L21-Red, G47-White, G46-Green" to the lights 21 to 25.

Figure 7:
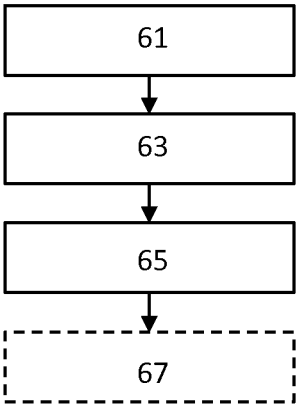
FIG. 7 is a flow diagram of an embodiment of the method of the invention.

A first embodiment of the method of facilitating control of devices is shown in FIG. 7. A step 61 comprises receiving device control information. The device control information specifies how devices should be controlled. A step 63 comprises forming a group of identified devices by analyzing the device control information, the identified devices of the group being controlled similarly according to the device control information. A step 65 comprises transmitting at least one message comprising an identifier of the group to allow the identified devices to be configured to carry out one or more commands comprising the identifier when receiving such one or more commands. The at least one message identifies the identified devices of the group.

The device control information may comprise a device script that comprises a plurality of commands for controlling a plurality of not yet identified devices or a plurality of commands for controlling a plurality of identified devices. The plurality of identified devices comprises at least the identified devices of the group. The plurality of commands for controlling a plurality of not yet identified devices specifies required properties of one or more devices to be controlled.

In the embodiment of FIG. 7, the method further comprises a step 67 of transmitting one or more commands for controlling one or more groups of identified devices and/or one or more individually identified devices. The one or more groups of identified devices comprises the group of identified devices.

Figure 8:
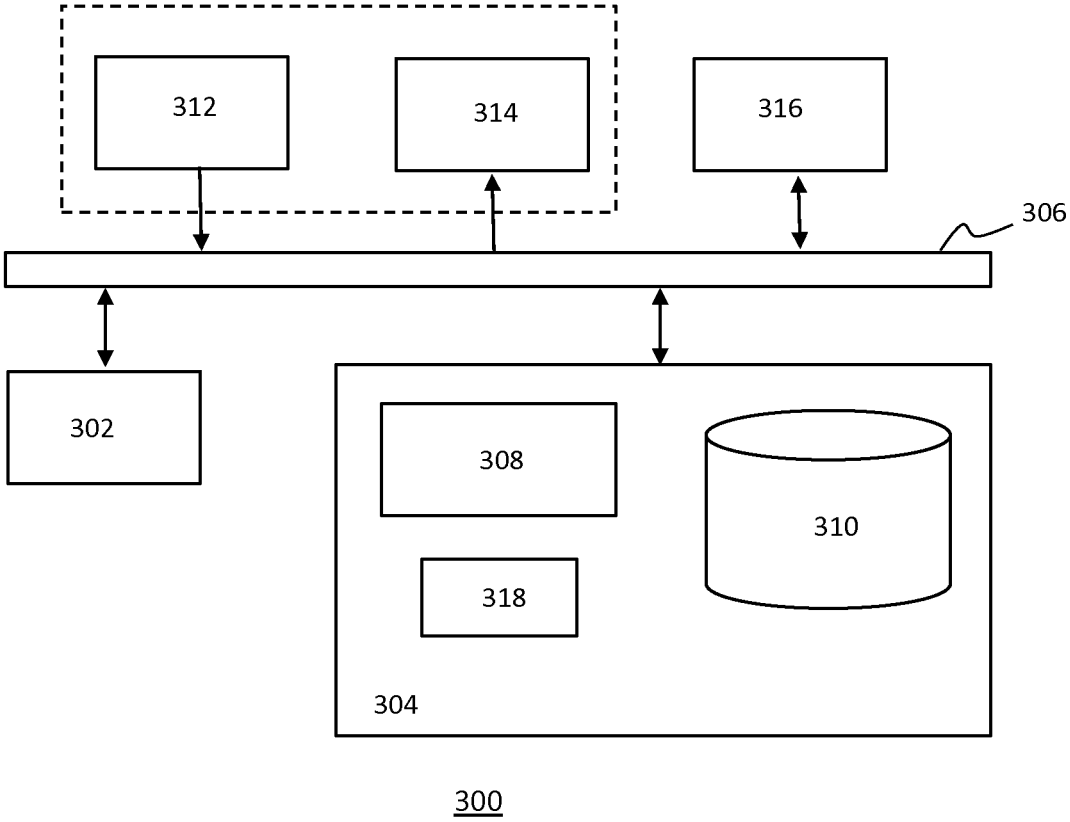
FIG. 8 is a block diagram of an exemplary data processing system for performing the method of the invention.

FIG. 8 depicts a block diagram illustrating an exemplary data processing system that may perform the method as described with reference to FIG. 7.

As shown in FIG. 8, the data processing system 300 may include at least one processor 302 coupled to memory elements 304 through a system bus 306. As such, the data processing system may store program code within memory elements 304. Further, the processor 302 may execute the program code accessed from the memory elements 304 via a system bus 306. In one aspect, the data processing system may be implemented as a computer that is suitable for storing and/or executing program code. It should be appreciated, however, that the data processing system 300 may be implemented in the form of any system including a processor and a memory that is capable of performing the functions described within this specification.

The memory elements 304 may include one or more physical memory devices such as, for example, local memory 308 and one or more bulk storage devices 310. The local memory may refer to random access memory or other non-persistent memory device(s) generally used during actual execution of the program code. A bulk storage device may be implemented as a hard drive or other persistent data storage device. The processing system 300 may also include one or more cache memories (not shown) that provide temporary storage of at least some program code in order to reduce the quantity of times program code must be retrieved from the bulk storage device 310 during execution.

Input/output (I/O) devices depicted as an input device 312 and an output device 314 optionally can be coupled to the data processing system. Examples of input devices may include, but are not limited to, a keyboard, a pointing device such as a mouse, or the like. Examples of output devices may include, but are not limited to, a monitor or a display, speakers, or the like. Input and/or output devices may be coupled to the data processing system either directly or through intervening I/O controllers.

In an embodiment, the input and the output devices may be implemented as a combined input/output device (illustrated in FIG. 8 with a dashed line surrounding the input device 312 and the output device 314). An example of such a combined device is a touch sensitive display, also sometimes referred to as a "touch screen display" or simply "touch screen". In such an embodiment, input to the device may be provided by a movement of a physical object, such as e.g. a stylus or a finger of a user, on or near the touch screen display.

A network adapter 316 may also be coupled to the data processing system to enable it to become coupled to other systems, computer systems, remote network devices, and/or remote storage devices through intervening private or public networks. The network adapter may comprise a data receiver for receiving data that is transmitted by said systems, devices and/or networks to the data processing system 300, and a data transmitter for transmitting data from the data processing system 300 to said systems, devices and/or networks. Modems, cable modems, and Ethernet cards are examples of different types of network adapter that may be used with the data processing system 300.

As pictured in FIG. 8, the memory elements 304 may store an application 318. In various embodiments, the application 318 may be stored in the local memory 308, the one or more bulk storage devices 310, or separate from the local memory and the bulk storage devices. It should be appreciated that the data processing system 300 may further execute an operating system (not shown in FIG. 8) that can facilitate execution of the application 318. The application 318, being implemented in the form of executable program code, can be executed by the data processing system 300, e.g., by the processor 302. Responsive to executing the application, the data processing system 300 may be configured to perform one or more operations or method steps described herein.

Various embodiments of the invention may be implemented as a program product for use with a computer system, where the program(s) of the program product define functions of the embodiments (including the methods described herein). In one embodiment, the program(s) can be contained on a variety of non-transitory computer-readable storage media, where, as used herein, the expression "non-transitory computer readable storage media" comprises all computer-readable media, with the sole exception being a transitory, propagating signal. In another embodiment, the program(s) can be contained on a variety of transitory computer-readable storage media. Illustrative computer-readable storage media include, but are not limited to: (i) non-writable storage media (e.g., read-only memory devices within a computer such as CD-ROM disks readable by a CD-ROM drive, ROM chips or any type of solid-state non-volatile semiconductor memory) on which information is permanently stored; and (ii) writable storage media (e.g., flash memory, floppy disks within a diskette drive or hard-disk drive or any type of solid-state random-access semiconductor memory) on which alterable information is stored. The computer program may be run on the processor 302 described herein.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of embodiments of the present invention has been presented for purposes of illustration, but is not intended to be exhaustive or limited to the implementations in the form disclosed. Many modifications and variations will be apparent to those of ordinary skill in the art without departing from the scope and spirit of the present invention. The embodiments were chosen and described in order to best explain the principles and some practical applications of the present invention, and to enable others of ordinary skill in the art to understand the present invention for various embodiments with various modifications as are suited to the particular use contemplated.

The invention claimed is:

1. A system for facilitating control of a plurality of lighting devices, said system comprising:

at least one receiver;

at least one transmitter; and at least one processor configured to:

receive, via said at least one receiver, a light script specifying how the lighting devices are controlled, analyze said light script to identify at least a subset of lighting devices of said plurality of lighting devices that are controlled similarly according to said light script, form an incipient conception of a group of identified lighting devices of said subset based on said analysis of said light script, transmit, via said at least one transmitter, at least one message identifying said identified lighting devices of said group and comprising an identifier of said group, said at least one message causing said identified lighting devices of said group to be configured to carry out subsequent commands comprising said identifier, receive lighting control assignments in which lighting control instructions are assigned to said subset, and reassign said lighting control instructions such that said group is formed.

2. The system of claim 1, wherein said light script comprises a plurality of commands, and each command of said plurality of commands specifies properties of one or more lighting devices to be controlled.

3. The system of claim 2, wherein said at least one processor is configured to identify one or more lighting devices of said subset having said properties for each command of said plurality of commands.

4. The system of claim 3, wherein said at least one processor is configured to form said group of identified lighting devices from said identified one or more lighting devices by analyzing said plurality of commands.

5. The system of claim 1, wherein said light script comprises a plurality of commands for controlling a plurality of identified lighting devices and said plurality of identified lighting devices comprises at least said identified lighting devices of said group.

6. The system of claim 5, wherein said light script identifies at least one previously formed group of one or more of said plurality of identified lighting devices.

7. The system of claim 1, wherein said group is a first group and wherein said at least one processor is further configured to use said at least one transmitter to transmit one or more commands for controlling one or more groups of identified lighting devices and/or one or more individually identified lighting devices, said one or more groups of identified lighting devices comprising said first group.

8. The system of claim 7, wherein said at least one processor is configured to form said first group and transmit said at least one message before transmitting any of said one or more commands.

9. The system of claim 7, wherein said at least one processor is configured to form said first group and transmit said at least one message after transmitting at least one of said one or more commands.

10. The system of claim 1, wherein said at least one processor is further configured to form one or more further groups of identified lighting devices by analyzing said light script, said identified devices of each of said one or more further groups being controlled similarly according to said light script.

11. A method of facilitating control of a plurality of lighting devices, said method comprising:

receiving, by at least one receiver, a light script specifying how the lighting devices are controlled;

analyzing said light script to identify at least a subset of lighting devices of said plurality of lighting devices that are controlled similarly according to said light script and assigning lighting control instructions to said subset, forming an incipient conception of a group of identified lighting devices of said subset based on said analysis of said light script and reassigning said lighting control instructions such that said group is formed; and transmitting, via at least one transmitter, at least one message identifying said identified lighting devices of said group and comprising an identifier of said group, said at least one message causing said identified lighting devices of said group to be configured to carry out subsequent commands comprising said identifier.

12. The method of claim 11, wherein said light script comprises a plurality of commands, and each command of said plurality of commands specifies properties of one or more lighting devices to be controlled.

13. The method of claim 11, wherein said light script comprises a plurality of commands for controlling a plurality of identified lighting devices and said plurality of identified lighting devices comprises at least said identified lighting devices of said group.

14. The method of claim 11, wherein said group is a first group and wherein the method further comprises transmitting one or more commands for controlling one or more groups of identified lighting devices and/or one or more individually identified lighting devices, said one or more groups of identified lighting devices comprising said first group.

15. A non-transitory storage medium comprising at least one software code portion, the software code portion, when run by at least one processor, being configured to cause said processor to perform the method of claim 11.

* * * * *